US005124307A

United States Patent [19]

Dalebroux et al.

[11] Patent Number: 5,124,307

[45] Date of Patent: Jun. 23, 1992

[54] THERMALLY-RESPONSIVE RECORD MATERIAL

[75] Inventors: Dean G. Dalebroux, Green Bay; Kenneth D. Glanz, Appleton, both of Wis.

[73] Assignee: Appleton Papers Inc., Appleton, Wis.

[21] Appl. No.: 745,571

[22] Filed: Aug. 15, 1991

[51] Int. Cl.[5] ..... B41M 5/30

[52] U.S. Cl. ..... 503/209; 427/151; 503/216; 503/225

[58] Field of Search ..... 427/151; 503/208, 209, 503/216, 225

[56] References Cited

U.S. PATENT DOCUMENTS 4,803,193 2/1989 Kanda et al. ..... 503/209

*Primary Examiner*—Pamela R. Schwartz

*Attorney, Agent, or Firm*—Benjamin Mieliulis

[57] ABSTRACT

A novel thermally-responsive record material is disclosed comprising a support having provided thereon in substantially contiguous relationship an electron donating dye precursor and a fluorene bisphenol of the formula

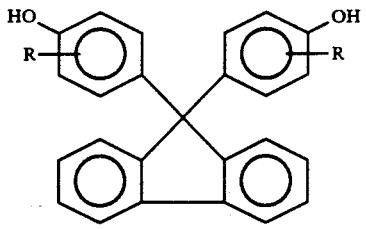

(I)

wherein each R is independently selected from hydrogen and $C_1$ to $C_8$ alkyl, and a suitable binder therefor.

The record material according to the invention when imaged resists fade when contacted with certain environmental challenges including oils, solvents, and elevated temperatures, all of which can be encountered in the environments of use of these record materials.

12 Claims, No Drawings

THERMALLY-RESPONSIVE RECORD MATERIAL

BACKGROUND OF THE INVENTION

1. Field of Invention

This invention relates to thermally-responsive record material. It more particularly relates to such record material in the form of sheets coated with color-forming systems comprising chromogenic material (electron-donating dye precursors) and acidic color developer material. This invention particularly concerns a thermally-responsive record material capable of forming a non-reversible image resistant to fade or erasure due to contact with oils, solvents or exposure to elevated temperature. The invention teaches a record material having improved image density retention.

2. Description of Related Art

Thermally-responsive record material systems are well known in the art and are described in many patents, for example, U.S. Pat. Nos. 3,539,375; 3,674,535; 3,746,675; 4,151,748; 4,181,771; 4,246,318; and 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Thermally-responsive record materials have characteristic thermal responses, desirably producing a colored image of sufficient intensity upon selective thermal exposure.

A drawback of thermally-responsive record materials limiting utilization in certain environments and applications has been the undesirable tendency of thermally-responsive record materials upon forming an image to not retain that image in its original integrity over time when the thermally-responsive record material is handled or exposed to common liquids or oils or plasticizers such as found in skin oil, plastic food wrap, cooking oil and solvents such as common carbonless paper solvents. As a result, a high degree of care and control in handling imaged thermally-responsive record materials has been required. This loss of image density and fade can be not only annoying but potentially detrimental whenever the integrity of records is allowed to become suspect through improper record storage.

The ability of a thermally-responsive record material to resist image fading or erasure upon contact with common oils, solvents or plasticizers would be an advance in the art and of commercial significance.

It is an object of the present invention to disclose a thermally-responsive record material having improved image retention and resistance to fade or erasure. The record material of the invention is remarkably resistant to fade or erasure when contacted with common oils, such as skin oil, internal phase carbonless solvents, or plasticizers.

It is an object of the present invention to disclose a thermally-responsive record material comprising a support member bearing a thermally-sensitive color forming composition comprising chromogenic material and acidic developer material in substantially contiguous relationship, whereby the melting or sublimation of either material produces a change in color by reaction between the two, and a suitable binder therefor.

DETAILED DESCRIPTION

The present invention is a novel thermally-responsive record material bearing a thermally-sensitive color-forming composition comprising a chromogenic material, and a fluorene bisphenol of the formula

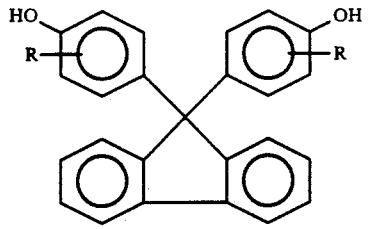

(I)

wherein each R is independently selected from hydrogen or $C_1$–$C_8$ alkyl.

The fluorene bisphenol is an acidic developer material and is in substantially in contiguous relationship with the chromogenic material whereby the melting or sublimation of either material produces a change in color by reaction between the two.

Fluorene bisphenols according to the invention include 9,9bis(4-hydroxyphenyl) fluorene; 9,9-bis(4-hydroxy-3-alkylphenyl)fluorene, particularly alkyls of one to eight carbons, such as 9,9-bis(4-hydroxy-3-methylphenyl)fluorene, 9,9bis 4-hydroxy-3-ethylphenyl)fluorene, 9,9-bis(4-hydroxy-3butylphenyl)fluorene, 9,9-bis(4-hydroxy-3-octylphenyl)fluorene and the like; 9,9-bis(4-hydroxy-2-alkylphenyl)fluorene, particularly alkyls of one to eight carbons, such as 9,9-bis(4-hydroxy-2-methylphenyl) fluorene, 9,9-bis(4-hydroxy-2ethylphenyl)fluorene, 9,9-bis(4-hydroxy-2-propylphenyl)fluorene, 9,9-bis(4-hydroxy-2-octylphenyl)fluorene, and the like.

More preferred are those fluorenes with phenyl moieties Phenyl moieties with alkyl substitution at the 2 or 3 position also function in the invention. Of the alkyls, lower alkyls are preferable which are defined as alkyls of one to four carbons. Most preferred is fluorene-9-bisphenol (also known as 9,9-bis-4hydroxyphenyl)fluorene) and 9,9-bis(4-hydroxy-3methylphenyl)fluorene. Fluorene-9-bisphenol is more favored.

The thermally responsive record materials containing the above fluorene bisphenol are characterized by developing a thermal image that is resistant to erasure due to contact with oils, solvents and exposure to elevated temperatures, all of which may be encountered in normal office environments.

In addition to the chromogen and fluorene bisphenol other materials such as sensitizers, fillers, antioxidants, lubricants, waxes and brighteners optionally may be added if desired.

The thermally-responsive record material of the invention has the unexpected and remarkable properties of being capable of forming a non-reversible high density image upon selective thermal contact and of retaining that image over time when handled or exposed to common skin oils, internal phase carbonless solvents, and plasticizers. This remarkable ability of the fluorene bisphenols to impart fade and erasure resistance is a significant advance in the art.

The present invention is a novel thermally-responsive record material comprising a support having provided thereon in substantially contiguous relationship an electron donating dye precursor, the fluorene bisphenol of Formula (I) as the electron accepting developer compound, and a suitable binder therefor.

The invention comprises a thermally-sensitive color-forming composition comprising chromogenic material, a fluorene bisphenol acidic developer material of Formula (I) and binder material. The unexpected feature of this composition is that, the inclusion of the above fluorene bisphenol with prior art thermally-sensitive color-forming compositions results in a composition possessing improved resistance to fade and image erasure.

The record material according to the invention has a non-reversible image in that it is non-reversible under the action of heat. The coating of the record material of the invention is basically a dewatered solid at ambient temperature.

The color-forming system of the record material of this invention comprises chromogenic material in its substantially colorless or light-colored state and the fluorene bisphenol according to Formula (I) as acidic developer material. The color-forming system relies upon melting, softening, or subliming one or more of the components to achieve reactive, color-producing contact with the chromogen.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The invention resides in the color-forming composition coated on the substrate. The kind or type of substrate material is not critical.

The components of the color-forming system are in substantially contiguous relationship, substantially homogeneously distributed throughout the coated layer material deposited on the substrate. The term substantially contiguous is understood to mean that the color-forming components are positioned in sufficient proximity such that upon melting, softening or subliming one or more of the components, a reactive color forming contact between the components is achieved. As is readily apparent to the person of ordinary skill in this art, these reactive components accordingly can be in the same coated layer or layers, or isolated or positioned in separate layers. In other words, one component can be positioned in the first layer, and reactive or sensitizer components positioned in a subsequent layer or layers. All such arrangements are understood herein as being substantially contiguous.

In manufacturing the record material, a coating composition is prepared which includes a fine dispersion of the components of the color-forming system, binder material preferably polymeric binder such as polyvinyl alcohol, surface active agents and other additives in an aqueous coating medium. The composition can additionally contain inert pigments, such as clay, talc, silicone dioxide, aluminum hydroxide, calcined kaolin clay and calcium carbonate; synthetic pigments, such as urea-formaldehyde resin pigments; natural waxes such as Carnauba wax; synthetic waxes; lubricants such as zinc stearate; wetting agents; defoamers, sensitizers and antioxidants. Sensitizers, for example, can include acetoacet-o-toluidine, phenyl-1-hydroxy-2-naphthoate, 1,2-diphenoxyethane, and p-benzylbiphenyl. Use of sensitizer, specifically material such as 1,2-diphenoxyethane is preferred in all record system combinations herein. The sensitizer typically does not impact any image on its own but as a relatively low melt point solid, acts as a solvent to facilitate reaction between the mark-forming components of the color-forming system.

The color-forming system components are substantially insoluble in the dispersion vehicle (preferably water) and are ground to an individual average particle size of between about 1 micron to about 10 microns, preferably about 1–3 microns. The polymeric binder material is substantially vehicle soluble although latexes are also eligible in some instances. Preferred water soluble binders include polyvinyl alcohol, hydroxy ethylcellulose, methylcellulose, methyl-hydroxypropylcellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible electron donating dye precursors are chromogenic compounds, such as the phthalide, leucauramine and fluoran compounds, for use in the color-forming system are well known color-forming compounds. Examples of the compounds include Crystal Violet Lactone (3,3-bis(4-dimethylaminophenyl)-6dimethylaminophthalide, U.S. Pat. No. Re. 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spiro- dipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No, 3,681,390); 2-anilino-3-methyl-6-dibutylamino-fluoran (U.S. Pat. No. 4,510,513) also known as 3 -dibutylamino-6-methyl-7-anilino -fluoran; 3 -dibutylamino -7-(2-chloroanilino) fluoran; 3-(N-ethyl-N-tetrahydrofurfurylamino)-6-methyl-7-3,5,6-tris(dimethylamino)spiro[9H-fluorene-9,1',(3'H)-isobenzofuran]-3'-one; 7-(I-ethyl-2-methylindol-3-yl)-7-(4-diethylamino-2-ethoxyphenyl) -5,7-dihydrofuro[3,4-b]pyridin-5-one (U.S. Pat. No.4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl) -7-(4-diethylamino-2-ethoxyphenyl) -5,7-dihydrofuro[3,4-b]pyridin-5-one; 3-diethylamino-7,8-benzofluoran; 3,3-bis(1-ethyl -2-methylindo 1-3- yl)

phthalide; 3-diethylamino-7-anilinofluoran; 3-diethylamino-7-benzylaminofluoran; 3,-phenyl-7-dibenzylamino-2,2'-spiro-di-[2H-I-benzopyran]and mixtures of any of the following.

The fluorene bisphenol materials of the invention are acidic developer materials. The fluorene bisphenol developers can used alone or in combination with any of the known acidic developer materials for record systems.

Examples of such other eligible acidic developer material which can be used in combination with the fluorene bisphenol of the invention include the compounds listed in U.S. Pat. No. 3,539,375 as phenolic reactive material, particularly the monophenols and diphenols. Other eligible acidic developer 10 material which can be used in such combination also include, without being considered as limiting, the following compounds:

4,4'-isopropylidinediphenol (Bisphenol A); p -hydroxybenzaldehyde; p-hydroxybenzophenone; p-hydroxypropiophenone; 2,4-dihydroxybenzophenone; 1,1-bis(4-hydroxyphenyl)cyclohexane; salicyanilide; 4-hydroxy-2-methylacetophenone; 2-acetylbenzoic acid; m -hydroxyacetanilide ; p -hydroxyacetanilide; 2,4-dihydroxyacetophenone; 4-hydroxy-4,-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl) -5-methylhexane; ethyl-4,4 -bis(4-hydroxyphenyl) -pentanoate; isopropy1-4,4-bis(4-hydroxyphenyl) pentanoate; methyl -4,4-bis(4-hydroxyphenyl) pentanoate; allyl -4,4 -bis(4-hydroxyphenyl) pentanoate; 3,3 -bis(4-hydroxyphenyl) -pentane; 4,4-bis(4-hydroxyphenyl)-heptane; 2,2-bis(4-hydroxy-phenyl)-1-phenylpropane; 2,2-bis(4-hydroxyphenyl)butane; 2,2,-methylene-bis(4-ethyl-6-tertiarybutyl phenol); 4-hydroxy-coumarin; 7-hydroxy-4-methylcoumarin; 2,2,-methylene-bis(4-octylphenol); 4,4,-sulfonyldiphenol; 4,4'-thiobis (6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4,-isopropylindinediphenol, ethyl-4,4-bis(4-hydroxyphenyl) -pentanoate, n -propyl -4,4- bis (4-hydroxyphenyl) pentanoate, isopropyl -4, 4-bis(4-hydroxyphenyl) pentanoate, methyl-4,4-bis(4-hydroxyphenyl)pentanoate, 2,2-bis(4-hydroxy-phenyl)-4-methylpentane, p-hydroxybenzophenone, 2,4-dihydroxybenzophenone, 1,1-bis(4-hydroxyphenyl)cyclohexane, and benzyl-p-hydroxybenzoate. Acid compounds of other kind and types are eligible.

Use of the fluorene bisphenol of Formula I, together with 4,4'-isopropylidiendiphenol was preferred. 9,9-bis(4-hydroxy-3methylphenyl)fluorene together 4,4'-isopropoxydiphenol was preferred in that such combination exhibited reduced background discoloration.

Examples of other eligible acidic developer compounds for use with the fluorene bisphenol of the invention are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

The fluorene bisphenols of Formula I are functional as the acidic developer material when such fluorene bisphenols are used alone.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component was prepared by milling the component in an aqueous solution of the binder until a particle size of between about 1 micron and !0 microns was achieved. The milling was accomplished in an attritor or other suitable milling device. The desired average particle size was about 1–3 microns in each dispersion.

The thermally-responsive sheets were made by making separate dispersions of chromogenic material, sensitizer material, bisphenol fluorene and/or other acidic developer material. The dispersions were mixed in the desired ratios and applied to a support with a wire wound rod and dried. Other materials such as fillers, antioxidants, lubricants and waxes can be added if desired. The sheets may be calendered to improve smoothness.

The thermal performance of the sheet is measured by imaging the sheet on a dynamic thermal test device, in this case an Atlantek Thermal Response Tester, Model 200. The thermal testing unit images the sheet with a thermal printhead, using a constant power voltage, a constant cycle time, and a sequentially increasing dot pulse duration resulting in a series of thermal images of increasing intensity. The thermal images are measured using a MacBeth RD-922 densitometer. The densitometer is calibrated such that 0.05 indicates pure white and 1.79 a fully saturated black image.

Resistance to image intensity decline upon exposure to elevated temperature is measured by placing a dynamically imaged sheet in a 60° C. oven for a period of 24 hours. The image intensity is measured both before and after this exposure period.

Resistance to image erasure due to contact with skin oil is done by applying a fingerprint (5 second contact) to a thermally imaged portion of the sheet. The image intensity is measured before fingerprint contact then again 60 days after fingerprint contact with the MacBeth RD-922 densitometer.

Resistance to image erasure due to contact with carbonless paper internal phase solvent is determined by applying a small amount of the internal phase solvent to an imaged area with a cotton swab. Image intensities are recorded both before and after the 60 day exposure period as described above.

Dispersions

Dispersions
Dispesion A - Chromogenic Material

| | Parts |
|---|---|
| Chromogenic Material | 35.3 |
| Binder, 20% Solution of Polyvinyl Alcohol (Vinol 205) in Water | 30.2 |
| Defoaming and Dispersing Agents | 0.5 |
| Water | 34.0 |
| Total | 100.0 |

Dispersion A—1 - Chromogenic Material is N-102, 3-Diethylamino-6-Methyl-7-Anilinofluoran.

| Dispersion B - Acidic Material | Parts |
|---|---|
| Acidic Material | 17.0 |
| Binder, 28% Solution of Polyvinyl Alcohol (Vinol 203) in Water | 10.4 |
| Defoaming and Dispersing Agents | 0.1 |
| Water | 72.5 |
| Total | 100.0 |

Dispersion B—1 - Acidic Material is Fluorene-9-bisphenol.

Dispersion B—2 - Acidic Material is 9,9-bis(4-hydroxy-3- methylphenyl) fluorene.

| Dispersion C - Acidic Material | Parts |
|---|---|
| Acidic Material | 35.4 |
| Binder, 28% Solution of Polyvinyl Alcohol (Vinol 203) in Water | 21.5 |
| Defoaming and Dispersing Agents | 0.2 |
| Water | 42.9 |
| Total | 100.0 |

Dispersion C—1 - Acidic Material is AP-5, 2,2-Bis(4-Hydroxyphenyl)-4-Methylpentane.

| Dispersion D - Sensitizing Material | Parts |
|---|---|
| Sensitizing Material | 33.5 |
| Binder, 28% Solution of Polyvinyl Alcohol (Vinol 205) in Water | 20.4 |
| Defoaming and Dispersing Agents | 0.2 |
| Water | 45.9 |
| Total | 100.0 |

Dispersion D—1 - Sensitizing Material is DPE, 1,2-Diphenoxyethane.

Water soluble polyumers other than polyvinyl alcohol may be used to prepare the dispersions.

The chromogenic, acidic, sensitizing and filler materials listed are illustrative and not intended to be limiting.

EXAMPLE 1 (Control)

| | Parts |
|---|---|
| Dispersion A-1 (Chromogenic Material = N-102) | 4.80 |

-continued

| | Parts |
|---|---|
| Dispersion C-1 (Acidic Material = AP-5) | 11.30 |
| Dispersion D-1 (Sensitizing Material = DPE) | 11.95 |
| Zinc Stearate Emulsion at 32.3% Solids | 3.70 |
| Filler | 5.10 |
| Binder, 10% Solution of PVA (Vinol 325) in Water | 23.45 |
| Water | 39.70 |
| Total | 100.00 |

EXAMPLE 2 (Fluorene-9-Bisphenol)

| | Parts |
|---|---|
| Dispersion A-1 (Chromogenic Material = N-102) | 4.80 |
| Dispersion B-1 (Acidic Material = Fluorene-9-Bisphenol) | 23.55 |
| Dispersion D-1 (Sensitizing Material = DPE) | 11.95 |
| Zinc Stearate Emulsion at 32.3% Solids | 3.70 |
| Filler | 5.10 |
| Binder, 10% Solution of PVA (Vinol 325) in Water | 23.45 |
| Water | 27.45 |
| Total | 100.00 |

EXAMPLE 3
9,9-Bis(4-hydroxy-3-methylphenyl)fluorene

| | | Parts |
|---|---|---|
| Dispersion A-1 | (Chromogenic Material = N-102) | 4.80 |
| Dispersion B-2 | [Acidic Material = 9,9-Bis(4-hydroxy 3-methylphenyl) fluorene] | 23.55 |

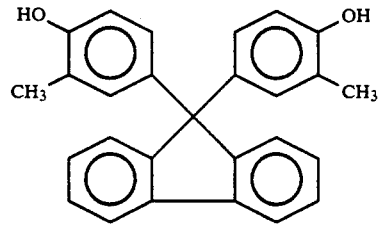

| | | |
|---|---|---|
| Dispersion D-1 | (Sensitizing Material = DPE) | 11.95 |
| ZnStearate emulsion at 32.3% solids | | 3.70 |
| Filler | | 5.10 |
| Binder, 10% solution of PVA (Vinol 325) in water | | 23.45 |
| Water | | 27.45 |
| TOTAL | | 100.00 |

TABLE 1

60° C. Image Stability/24 hour Exposure
Dynamic Thermal Response (17.5 Volts, 5.0 msec Cycle Time)

| | Example 1 (Control) | | | Example 2 (Fluorene-9-bisphenol) | | | Example 3 [9,9-Bis(4-hydroxy-3-methylphenyl)fluorene] | | |
|---|---|---|---|---|---|---|---|---|---|
| Pulse Width (msec) | Initial Image Intensity | Image Remaining After 60° C. Exposure | % Image Decline | Initial Image Intensity | Image Remaining after 60° C. Exposure | % Image Decline | Initial Image Intensity | Image Remaining After 60° Exposure | % Image Decline |
| 1.0 | 1.37 | 1.37 | 0.0 | 1.37 | 1.32 | 3.6 | 1.34 | 1.30 | 3.0 |
| 0.9 | 1.34 | 1.32 | 1.5 | 1.37 | 1.31 | 4.4 | 1.33 | 1.26 | 5.3 |
| 0.8 | 1.32 | 1.22 | 7.6 | 1.31 | 1.25 | 4.6 | 1.30 | 1.18 | 9.2 |
| 0.7 | 1.23 | 0.95 | 22.8 | 1.22 | 1.15 | 5.7 | 1.25 | 1.05 | 16.0 |
| 0.6 | 1.06 | 0.63 | 40.6 | 1.03 | 0.96 | 6.8 | 1.11 | .78 | 29.7 |
| 0.5 | 0.73 | 0.32 | 56.2 | 0.66 | 0.62 | 6.1 | .85 | .50 | 41.2 |
| 0.4 | 0.41 | 0.17 | 58.5 | 0.34 | 0.34 | 0.0 | .42 | .30 | 28.6 |
| 0.3 | 0.15 | 0.12 | — | 0.14 | 0.19 | — | .17 | .20 | — |
| 0.2 | 0.08 | 0.12 | — | 0.09 | 0.17 | — | .08 | .18 | — |
| 0.1 | 0.07 | 0.11 | — | 0.10 | 0.16 | — | .08 | .18 | — |
| Opacimeter | 85.2 | 80.7 | | 82.4 | 72.7 | | 83.8 | 68.0 | |

TABLE 1-continued

| | 60° C. Image Stability/24 hour Exposure Dynamic Thermal Response (17.5 Volts, 5.0 msec Cycle Time) | | | | | | | | |
|---|---|---|---|---|---|---|---|---|---|
| | Example 1 (Control) | | | Example 2 (Fluorene-9-bisphenol) | | | Example 3 [9,9-Bis(4-hydroxy-3-methylphenyl)fluorene] | | |
| Pulse Width (msec) | Initial Image Intensity | Image Remaining After 60° C. Exposure | % Image Decline | Initial Image Intensity | Image Remaining after 60° C. Exposure | % Image Decline | Initial Image Intensity | Image Remaining After 60° Exposure | % Image Decline |
| Background | | | | | | | | | |

TABLE 2

| | Image Stability to Skin Oil (60 Day Exposure) | | |
|---|---|---|---|
| | Initial Image Intensity | 60 Day Image Intensity | Change in Intensity |
| Example 1 (Control) | 1.16 | 0.91 | −0.25 |
| Example 2 (Fluorene-9-Bisphenol) | 1.12 | 1.12 | 0.00 |

TABLE 3

| | Image Stability to Carbonless Paper Internal Phase Solvent (60 Day Exposure) | | |
|---|---|---|---|
| | Initial Image Intensity | 60 Day Image Intensity | Change in Intensity |
| Example 1 (Control) | 1.24 | 0.64 | −0.60 |
| Example 2 (Fluorene-9-Bisphenol) | 1.17 | 1.13 | −0.04 |

TABLE 4

| | Image Stability to Skin Oil (60 Day Exposure) | | |
|---|---|---|---|
| | Initial Image Intensity | 60 Day Image Intensity | Change in Intensity |
| Example 1 (Control) | 1.25 | .66 | −.59 |
| Example 3 [9,9-Bis-(4-hydroxy-3-methylphenyl)-fluorene] | 1.23 | 1.22 | −.01 |

TABLE 5

| | Image Stability to Carbonless Paper Internal Phase Solvent (60 Day Exposure) | | |
|---|---|---|---|
| | Initial Image Intensity | 60 Day Image Intensity | Change in Intensity |
| Example 1 (Control) | 1.26 | .84 | −.42 |
| Example 3 [9,9-Bis-(4-hydroxy-3-methylphenyl)-fluorene] | 1.24 | .89 | −.35 |

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

What is claimed is:

1. A thermally-responsive record material comprising a support having provided thereon in substantially contiguous relationship an electron donating dye precursor, a fluorene bisphenol of the formula

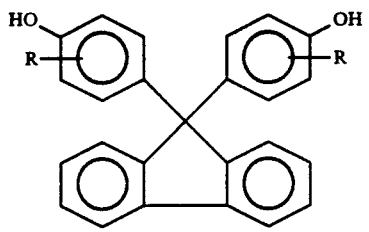

(I)

wherein each R is independently selected from hydrogen and $C_1$ to $C_8$ alkyl, and a suitable binder therefor.

2. The record material according to claim 1 wherein the fluorene bisphenol is 9,9-bis(4-hydroxy-3-alkylphenyl)fluorene.

3. The record material according to claim 1 wherein the fluorene bisphenol is fluorene-9-bisphenol.

4. The record material according to claim 1 wherein the fluorene bisphenol is 9,9-bis(4-hydroxy-3-methylphenyl)fluorene.

5. The record material according to claim 1 including in addition a developer selected from 4,4'-isopropylidenediphenol and 2,2-bis(4-hydroxyphenyl)-4-methylpentane.

6. The record material according to claim 1 wherein R is hydrogen.

7. A thermally-responsive record material comprising a support having provided thereon in substantially contiguous relationship an electron-donating dye precursor, a fluorene bisphenol of the formula

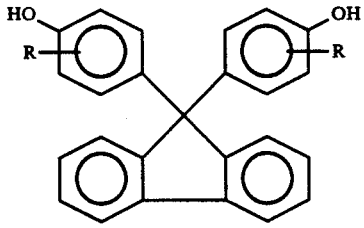

(I)

wherein each R is independently selected from hydrogen and $C_1$ to $C_8$ alkyl, a sensitizer, and a suitable binder therefor.

8. The record material according to claim 7 wherein the sensitizer is selected from acetoacet-o-toluidine, phenyl-1-hydroxy-2-naphthoate, 1,2-diphenoxyethane, and p-benzylbiphenyl.

9. The record material according to claim 7 wherein R is selected from alkyl of one to four carbons and hydrogen.

10. The record material according to claim 7 wherein the fluorene bisphenol is 9,9-bis(4-hydroxy-3-alkylphenyl)fluorene.

11. The record material according to claim 7 wherein the fluorene bisphenol is 9,9-bis(4-hydroxy-3-methylphenyl)fluorene.

12. The record material according to claim 7 wherein the fluorene bisphenol is 9,9-bis(4-hydroxyphenyl)fluorene.

* * * * *